US010647541B2

(12) United States Patent
Díaz Cruz et al.

(10) Patent No.: US 10,647,541 B2
(45) Date of Patent: May 12, 2020

(54) KNOT-TYING HEAD

(71) Applicant: AIRBUS DEFENCE AND SPACE, S.A.U., Madrid (ES)

(72) Inventors: José Carlos Díaz Cruz, Madrid (ES); Tamara Ramos Santana, Madrid (ES); Josef Ignacio Hotz Ordoño, Madrid (ES); Juan Torres Moreno, Madrid (ES); Alberto Perez Barthelemy, Madrid (ES); Ángel David Fraile Martín, Madrid (ES); Carlos Páez Crespo, Madrid (ES)

(73) Assignee: AIRBUS DEFENCE AND SPACE, S.A.U., Madrid (ES)

( * ) Notice: Subject to any disclaimer, the term of this patent is extended or adjusted under 35 U.S.C. 154(b) by 153 days.

(21) Appl. No.: 15/892,857

(22) Filed: Feb. 9, 2018

(65) Prior Publication Data

US 2018/0229870 A1 Aug. 16, 2018

(30) Foreign Application Priority Data

Feb. 10, 2017 (EP) ..... 17382065

(51) Int. Cl.

| | |
|---|---|
| ***B65H 69/04*** | (2006.01) |
| ***B65B 13/26*** | (2006.01) |
| ***B65B 27/06*** | (2006.01) |

(52) U.S. Cl.

CPC ..... *B65H 69/043* (2013.01); *B65B 13/26* (2013.01); *B65B 27/06* (2013.01)

(58) Field of Classification Search

CPC ..... B65H 69/043; B65H 69/046; B65B 27/06
See application file for complete search history.

(56) References Cited

U.S. PATENT DOCUMENTS

| | | | | |
|---|---|---|---|---|
| 876,573 | A | 1/1908 | Myers | |
| 2,913,271 | A * | 11/1959 | Sachsenroder, Sr. | A01F 15/14 289/2 |
| 3,336,063 | A * | 8/1967 | Remmers | B65H 69/046 289/2 |
| 3,490,801 | A * | 1/1970 | Feighery | B65H 69/046 289/2 |

(Continued)

FOREIGN PATENT DOCUMENTS

| | | | | |
|---|---|---|---|---|
| JP | 2006176333 | A * | 7/2006 | B65H 69/046 |

OTHER PUBLICATIONS

Extended European Search Report for EP 17382065.5, dated Aug. 25, 2017, 8 pages.

*Primary Examiner* — Shaun R Hurley
(74) *Attorney, Agent, or Firm* — Nixon & Vanderhye P.C.

(57) ABSTRACT

A knot-tying head adapted to form a knot with a filament around a cylindrical part, and wherein the knot-tying head includes a first body and a second body, wherein both bodies are configured such that when they are attached they form a hollow space between one another for receiving the part; wherein the first body and the second body include at least one conduit forming a path substantially around the hollow space, and the conduit being adapted to receive the filament, and at least one groove communicating the conduit with the hollow space along all or part of its path, the width of the groove being less than the width of the conduit and greater than the width of the filament used to form the knot.

12 Claims, 4 Drawing Sheets

(56) References Cited

U.S. PATENT DOCUMENTS

| | | | | |
|---|---|---|---|---|
| 3,563,583 | A * | 2/1971 | Gentry | A01G 17/085 289/2 |
| 3,591,217 | A * | 7/1971 | Melzer | B65H 69/046 289/2 |
| 4,094,342 | A * | 6/1978 | Nishikawa | B65B 13/04 140/93.2 |
| 4,542,773 | A * | 9/1985 | Lafon | B21F 15/00 140/93.6 |
| 4,572,555 | A * | 2/1986 | Henderson, Jr. | B65H 69/043 289/17 |
| 6,648,378 | B1 | 11/2003 | Torres et al. | |
| 7,883,122 | B2 * | 2/2011 | Orko | B65H 69/043 289/17 |
| 7,959,193 | B2 * | 6/2011 | Ng | B65H 69/046 289/15 |
| 8,414,035 | B2 * | 4/2013 | Bell | B65H 69/04 289/13 |
| 8,573,656 | B1 | 11/2013 | Zhang et al. | |
| 9,475,671 | B2 * | 10/2016 | Adler | A61F 2/0022 |
| 10,106,365 | B2 * | 10/2018 | Nikkanen | A01K 91/04 |
| 2008/0315023 | A1 * | 12/2008 | Orko | A01K 91/04 242/157 R |
| 2010/0194110 | A1 * | 8/2010 | Ng | B65H 69/046 289/1.5 |

* cited by examiner

KNOT-TYING HEAD

RELATED APPLICATION

This application claims priority to European Patent Application EP 17382065.5 filed Feb. 10, 2017, the entirety of which is incorporated by reference.

FIELD OF THE INVENTION

The present invention relates to a device, system and method for tying bundles of electrical cables by means of forming a knot around them, which can be automated and adapted to a wide range of diameters and types of knots.

BACKGROUND OF THE INVENTION

The ever-increasing use of electronic and digital systems in the transport sector has caused an increase in the extension and complexity of electrical installations, which are usually made up of power supply and communication cables clustered into bundles. In the aeronautics industry, this trend is more prominent: very long electric bundles made up of a high number of cables are installed in last-generation airplanes.

To form a bundle the cables must be clustered together and tied in a secure manner to form compact and wear-resistant bundle. These tying operations are usually performed by hand despite there being so many of them, affecting manufacturing times. The need to automate these operations as much as possible is therefore raised.

Several knot-tying machines are known, such as the one disclosed in US patent document U.S. Pat. No. 6,648,378 B1, showing an automatic device for tying knots on a part, such as a bundle of cables, for example. In one embodiment of said device, a complex mechanism made up of a series of rings and hooks allows arranging a filament around the part and forming a knot by transversely pulling on the filament.

Although this invention allows a simple and versatile operation by means of a pistol-like portable device, in practice the mechanism forming it limits both the type of knot and the diameter of the bundle that can be tied together by the knot.

Patent document U.S. Pat. No. 8,573,656 B1 discloses another machine that allows making knots automatically formed by a multi-actuator imitating the movement of a human hand making a knot by means of a coordinated sequence of actions.

One of the biggest drawbacks of this device is the complicated pneumatic installation which it requires and which limits its application in stationary processes.

SUMMARY OF THE INVENTION

A knot-typing system has been invented and is disclosed herein. A first inventive aspect provides a knot-tying head adapted to form a knot with a filament around a part, which part having an essentially cylindrical or prismatic portion, and wherein the knot-tying head comprises:

at least one first body, and at least one second body, complementary with the at least one first body, wherein the at least one first body and the at least one second body are configured such that when they are attached they form a hollow space between both bodies configured for receiving the part;

characterized in that the first body and the second body comprise:

at least one conduit made in the first body and the second body, the at least one conduit forming a path substantially around the hollow space, and the at least one conduit being adapted to receive the filament, and at least one groove communicating the at least one conduit with the hollow space along all or part of its path, the width of the groove being less than the width of the conduit, and greater than the width of the filament used to form the knot.

Throughout this document, head will be understood as a device formed by two or more parts the function of which is to allow the filament to form a path around an approximately cylindrical portion of space; filament will be understood as an element, which is preferably filiform, capable of transmitting a tensile load. Wires, cords or tapes can be mentioned as examples of filament. Furthermore, a knot will be understood as a particular arrangement of a filament, generally forming a loop or another structure and maintaining its structure by means of the friction of the filament or by means of the mechanical properties of the filament. The term part will be understood as the element to be tied, i.e., the element around which the filament is arranged to subsequently be tautened and form a knot; without prejudice to other options, the part can have a cylindrical shape, such as a cluster of electrical cables, for example, forming an electrical bundle.

Body must be interpreted to be each of the elements of the head, not necessarily identical, which allow the filament to form a path around the part, and have the particularity of being able to close around the part, the portion of space intended for housing the part being referred to as hollow space. In the present document, the term conduit must be understood as the parts of the bodies intended for guiding the filament for forming the path. Finally, groove must be understood as the part of the heads allowing passage of the filament from the conduit to the hollow space.

Advantageously, the knot-tying head allows a filament to form a path around an essentially cylindrical space, such that once the filament is tautened, it forms a knot on a part.

In a particular embodiment, the filament is a tape. Tape will be understood as a filament with an essentially rectangular section, the choice of this type of filament being advantageous because once the knot is tied, the loop around the part is flat and does not project too much from the profile of the part.

In another particular embodiment, the at least one first body and the at least one second body are attached in a hinged manner.

In the present document, hinged attachment will be understood as a device that allows attaching two elements such that they can rotate about a shaft, an example being a hinge. Advantageously, the hinged attachment allows opening and closing the knot-tying head to make it easier to position the part in the hollow space.

In an additional particular embodiment, the path of the conduit is configured for making a double capstan knot.

Without prejudice to other paths configured for forming other knots, the double capstan knot allows securely fixing, for example, a bundle of electrical cables, without requiring a path that is too complex. It is possible to provide other paths for forming other knots by means of heads manufactured specifically for each knot.

In another particular embodiment, the at least one first body and the at least one second body comprise at least one opening configured for the filament to enter or exit the conduit.

This opening or these openings allow the filament to be inserted and to exit once the path is completed.

Advantageously, the filament can be tautened through this opening or these openings by means of pulling on both ends of the filament at the same time.

In yet another particular embodiment, the at least one opening is arranged substantially in the portion in which the at least one first body and the at least one second body are hinged.

Advantageously, this arrangement makes it easier to implement an automated system for making the knot.

In another particular embodiment, the at least one first body and the at least one second body comprise two openings and are essentially communicated with one another.

Advantageously, the existence of two openings allows having an independent inlet and outlet for the filament; furthermore, the communication between the two openings, for example by means of a groove, allows tautening the ends of the filament more easily once the filament passes into the hollow space.

In a second inventive aspect, the invention provides a knot-tying system comprising: a knot-tying head, a filament feed device, and a filament pulling device.

Advantageously, the filament feed device allows providing the filament required for forming a knot on the part, and the filament pulling device allows producing pulling or compression on the filament or on another similar element that is introduced into the conduit.

In a particular embodiment, the filament feed device is a reel.

In a particular embodiment, the system comprises a filament cutting device and a filament tautening device.

Advantageously, the cutting device allows separating one end of the filament threaded into the conduit of the spool from which the system is fed, whereas the tautening device allows producing pulling on both ends of the filament for the purpose of securing the knot around the part.

In another particular embodiment, the system comprises an electronic control module for controlling the devices of the system and an actuator for the filament pulling device.

Advantageously, the control module allows carrying out the knot-tying process automatically, according to pre-programmed instructions. The actuator furthermore allows putting the pulling device in motion, for example by transmitting a rotation torque to the reel containing the filament.

In another particular embodiment, the system comprises a power source. Advantageously, the power source supplies power to the devices and to the control module and allows the system to be used independently from an external power supply source.

In an additional particular embodiment, the system constitutes a portable system. The system can therefore be handled by an operator directly at the site where the part is located, without having to take the part to an established work station.

In a third inventive aspect, the invention provides a method for forming a knot with a filament around a part, comprising the following steps:

providing a knot-tying system, placing the part in the knot-tying head, closing the first body and the second body, threading a guide for the filament into the conduit, attaching one end of the filament to the guide, threading the filament along the entire conduit of the head by means of pulling the guide, separating the end of the filament from the guide, tautening the filament around the part, and cutting the end of the filament attached to the filament feed device.

Throughout the present document, threading will be understood to consist of the action of introducing a filiform element into a cavity, for example into the conduit of the head. Guide must be understood as a filiform element and having certain rigidity, similar to the filament but without being consumable, and capable of transmitting compressive loads in order to, advantageously, be simply introduced into the conduit of the head. Furthermore, said guide comprises at one or both ends means for attaching the filament to the end of the guide, being possible to separate it from the guide at will.

Advantageously, the described method can be carried out by hand or automatically, controlled by means of the control module.

In another particular embodiment, the threading is done with the help of a pulling device. The pulling device therefore serves not only to apply pulling on the filament or guide, but it also can be used for threading the guide or the filament into the conduit.

In a final particular embodiment, the tautening is done with the help of a pulling device. Advantageously, the pulling device allows transmitting pulling or compression to an element threaded in the head, for example the filament, which in this embodiment is tautened by means of said device for securing the knot.

The invention may be embodied as A knot-tying head comprising:

first body having a front face and an channel in the front face extending from one side of the first body to an opposite side of the first body;

a second body having a front face and an channel in the front face extending from one side of the second body to an opposite side of the first body, wherein the front face of the second body is configured to seat against the front face of the first body such that the channels of the first and second bodies form an opening configured to receive a piece;

a conduit extending along a serpentine path through both of the first and second bodies and around the opening, wherein the conduit is continuous from an entrance opening to an exit opening, wherein each of the entrance and exit openings are on an outwardly facing surface of the first or second bodies;

a groove extending along the serpentine path through both of the first and second bodies, wherein the groove extends from the conduit to the opening along the lengths of the groove and conduit, wherein a width of the conduit is greater than a width of the groove, and the width of the groove is greater than a width of a filament intended to move through the conduit.

The serpentine path may be configured to cause the filament to form a knot around the piece after the filament slides from the conduit, through the groove and onto the piece. The serpentine path may encircle the opening at least twice. The serpentine path may form a loop within at least one of the first or second bodies, and the serpentine path may extends through the loop.

All the features and/or steps of methods described herein (including the claims, description and drawings) can be combined in any combination, with the exception of those combinations of such mutually exclusive features.

SUMMARY OF THE DRAWINGS

These and other features and advantages of the invention will be more clearly shown based on the following detailed description of a preferred embodiment, given solely by way of illustrative and non-limiting example in reference to the attached drawings.

DETAILED DESCRIPTION OF THE INVENTION

Figure 1A:
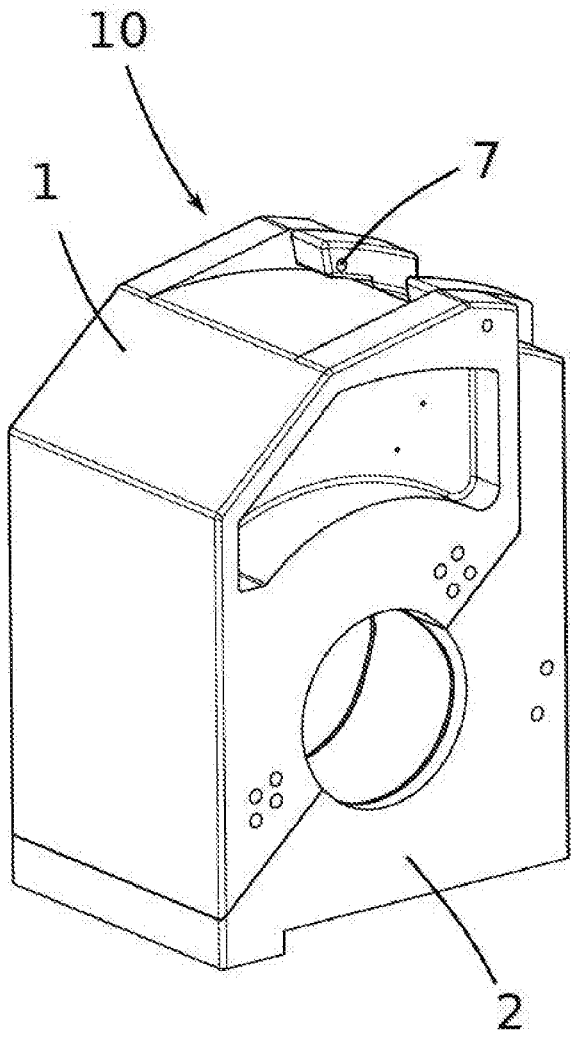
FIGS. 1A and 1B show a perspective and side view, respectively, of a knot-tying head closed.

The present invention describes a knot-tying device (10), a knot-tying system and a knot-tying method adapted to make a knot with a filament (6), for example a tape, around an approximately cylindrical part, particularly around a bundle of electrical cables in the electrical installation of an aircraft. The use of a tape tied in a knot for clustering together a set of cables, and possibly for fixing them to the structure of the aircraft, has a number of advantages over other options, the two main advantages probably being the lightweight feature and resistance to vibrations, factors that directly affect safety.

The head (10) has a series of conduits (3) in each of the bodies (1, 2) forming it; said conduits (3) are communicated with one another and together form a path corresponding to the trajectory the end of a cord would follow to form a given knot. The most favorable way to build said bodies (1, 2) consists of making a three-dimensional impression thereof, leaving the conduits (3) empty. Furthermore, the conduits (3) must be communicated with the central cavity by means of grooves (4) so that when the filament (6) is tautened, it slides out of the conduit (3), moves through the groove (4) and when the filament (6) reaches the hollow space (5), the knot is tightened on the part.

Each head (10) will be valid for only one type of knot, although it could be valid for parts having different diameters, which entails a logistic advantage because generally only one type of knot is used in installations of this type. The fact that the head (10) has very few moving parts is also advantageous both due to the simplicity in the operation and due to cost reduction and manageability.

Figure 1B:
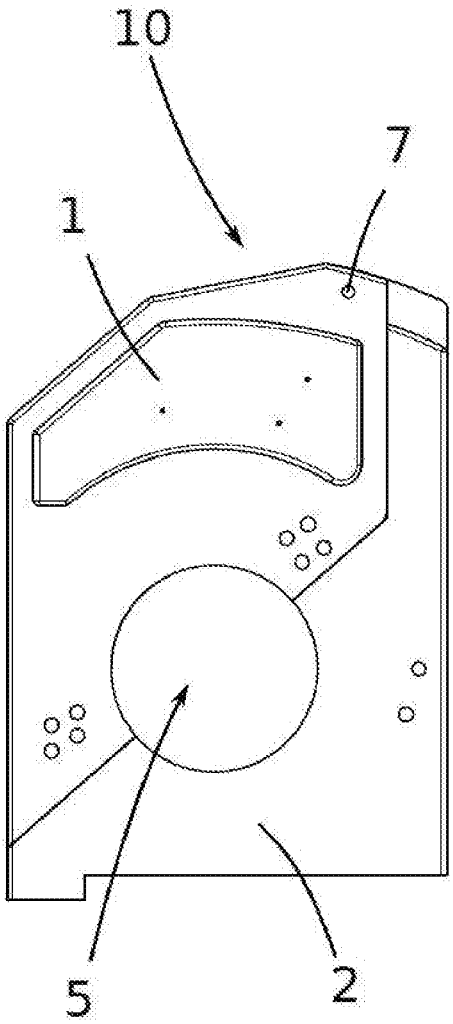

FIGS. 1A and 1B show an embodiment of the knot-tying head (10) with two bodies (1, 2) in the closed position. In this view it is easy to see that when the two bodies (1, 2) are closed they leave a cylindrical hollow space (5) between them, intended for housing the part to be tied up with a knot. In the closed position, the conduits (3) (not visible in FIGS. 1A and 1B) of the first body (1) are aligned with the conduits of the second body (2) such that a filament (6) is capable of going from one body to another (1, 2) and thereby completing its path; in this embodiment, the chosen path is the one corresponding to that a double capstan knot. The openings of the grooves (4) inside the hollow space (5), and the two openings (8) for the entry and/or exit of the filament (6) in one of the sides of the head (10) can also be seen in FIGS. 3A, 2A and 2B. The openings (8) are communicated with one another such that when the ends of the filament (6) are tautened, they can move freely and close the knot on the part. Finally, the hinged attachment (7) of the two bodies (1, 2) is visible in the upper part of the head (10).

It is also possible to build the bodies (1, 2) with recesses in those parts in which there are no conduits (3) for the purpose of reducing the weight of the head (10), reducing costs and making it more manageable.

Figure 2A:
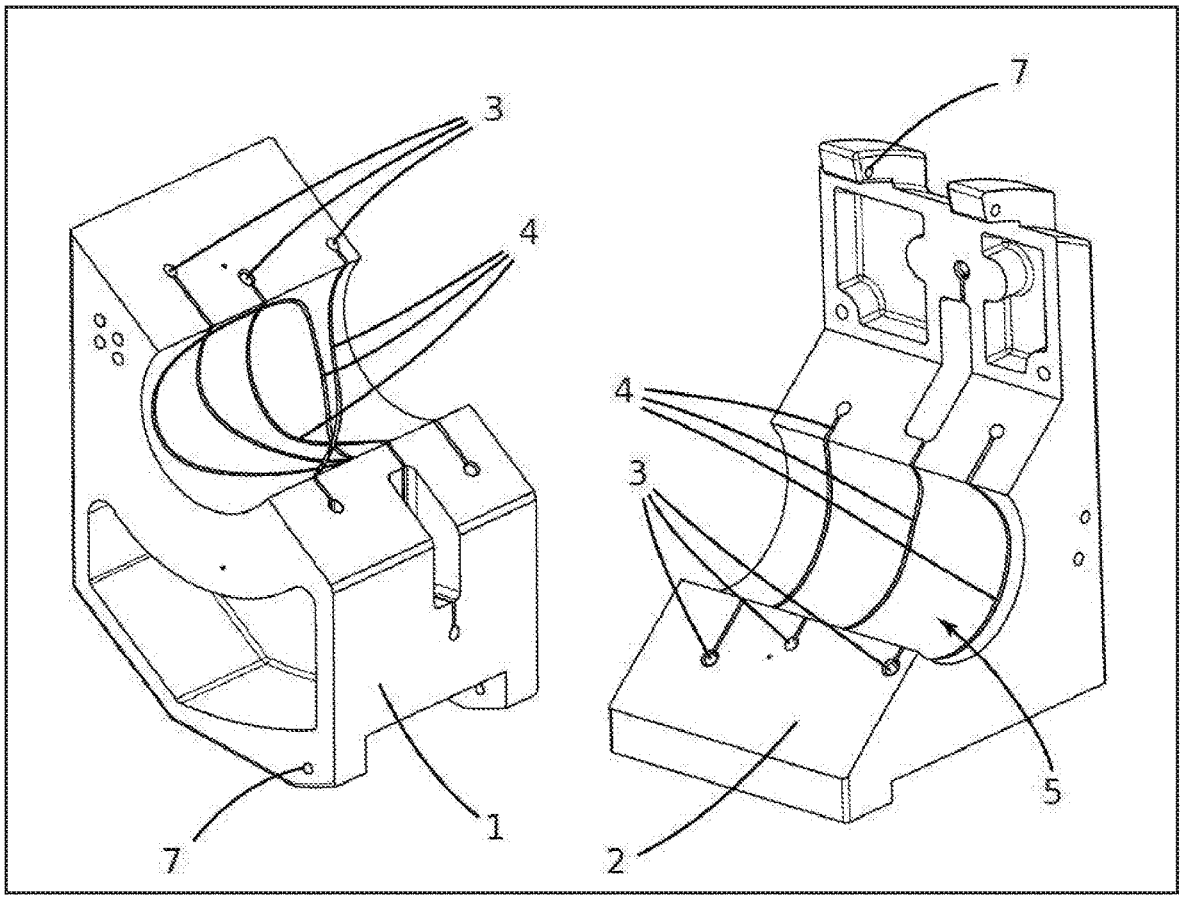
FIG. 2A shows the knot-tying head bodies opened.
Figure 2B:
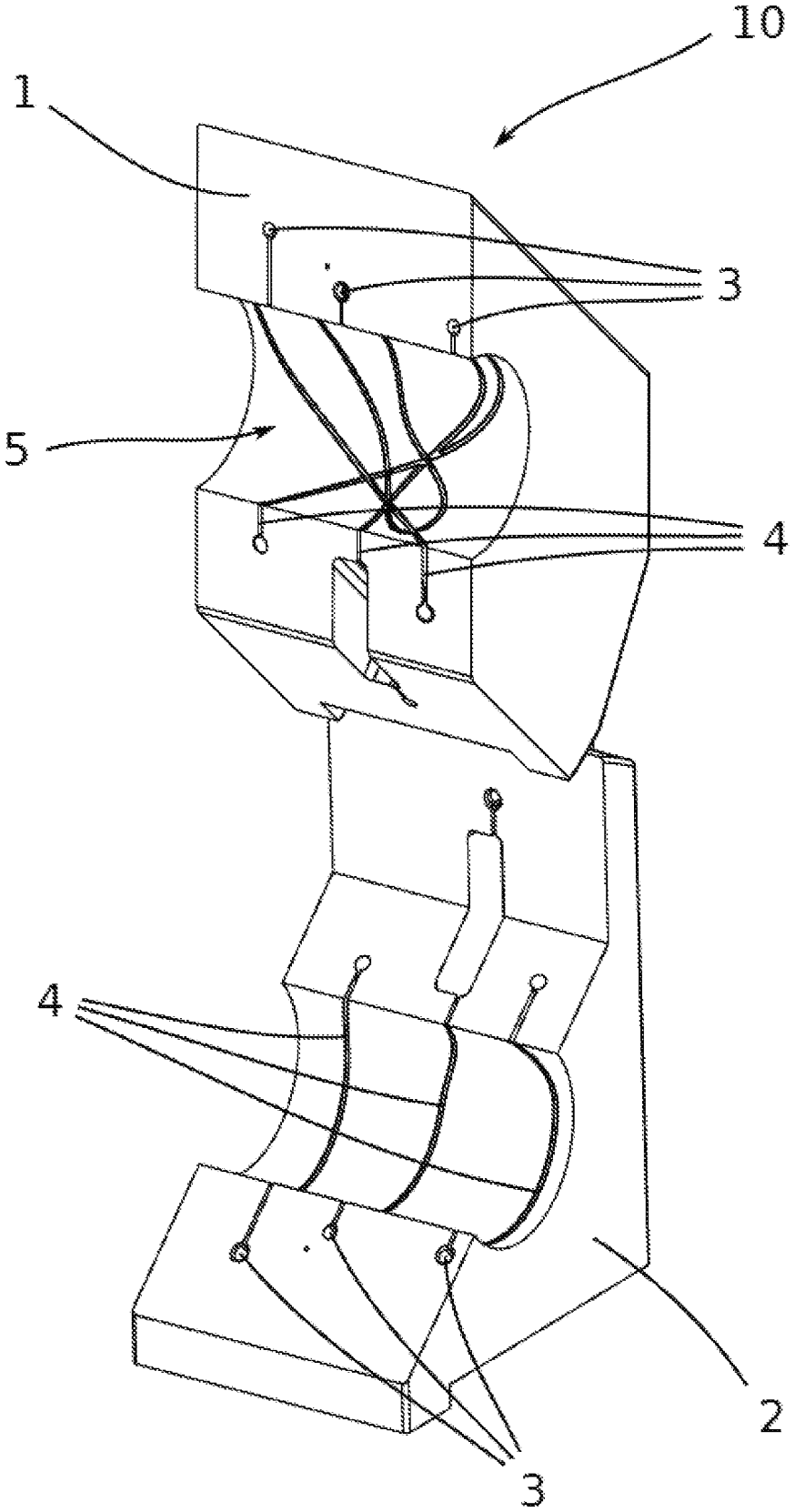
FIG. 2B show the two bodies of the knot-tying head in an open position.

FIG. 2*a* shows the same embodiment but with the two bodies (1, 2) separated from one another, whereas in FIG. 2*b* they are shown open. In this view it is possible to see the openings of the conduits (3) at the edges of both bodies (1, 2).

Figure 3A:
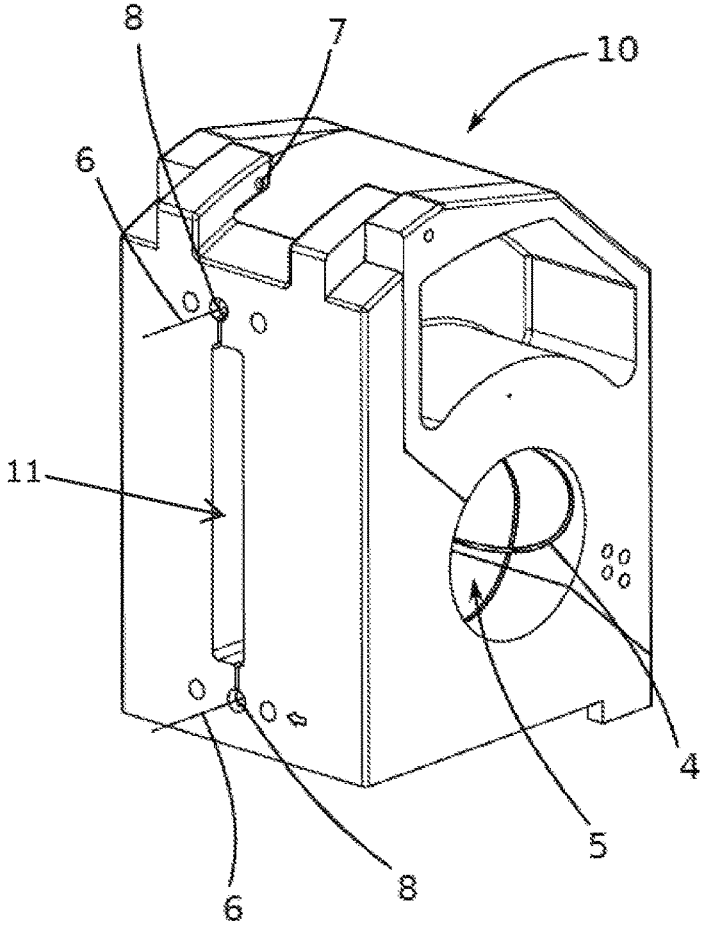
FIGS. 3*a* to 3*b* show a perspective view of the knot-tying head and of the path of the filament.
Figure 3B:
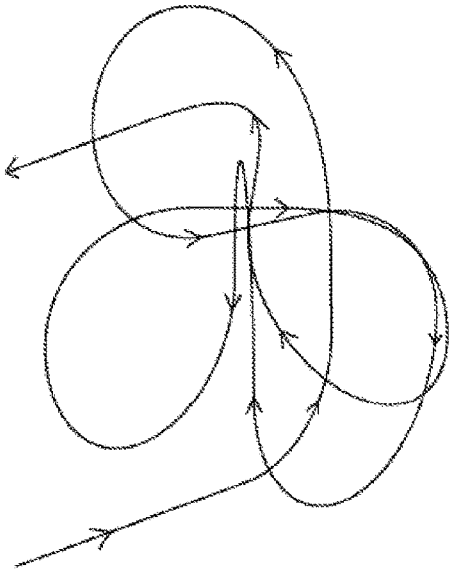

FIG. 3*a* again shows the head (10) closed, but it is possible to see the filament (6) exiting through the openings (8); furthermore, FIG. 3*b* shows the path of the conduit (3) which allows forming the knot and which is usually not visible in its entirety.

A particular embodiment of the knot-tying system comprises, in addition to the knot-tying head (10), a filament feed device, a filament pulling device and a cutting device. The function of the feed device is to provide the filament required to make the knot; a simple example of a feed device is a reel containing the tape mounted on a support. The filament pulling device is in charge of pulling out one or both of the ends of the filament projecting from the openings (8) in order for the knot to remain tight around the part. A slot (11) in one of the bodies (2) extends between the two openings (8). Finally, the cutting device separates the filament (6) already tied in a knot from the reel by cutting it with a blade, for example.

It is possible to incorporate an actuator into the feed device, for example with a stepper motor in the support, such that said feed device can tauten the filament (6) once the knot is tightened. In this case, a filament tautening device holding or pulling out the other end of the filament (6) must be incorporated.

Following the same principle, the system can be automated by adding actuators for each device (cutting device, tautening device, etc.) and an electronic control module controlling the process. This control module can be a computer, for example, capable of emitting control signals to the actuators depending on the signals received from a plurality of sensors detecting magnitudes such as the length of the filament (6), position of the cutting device, tautness in the filament (6), etc.

In order to use the head (10) at the site where the electrical installation is located, it is convenient to mount the head (10) on a portable system, which can be comfortably handled by an operator, for example in a pistol-like assembly. Furthermore, a power source, such as a battery, is particularly useful for a portable knot-tying system.

Regardless of if the system is operated by hand or automatically, the knot-tying method comprises the following steps:

Placing the part in the knot-tying head (10), usually by hand. This can also be interpreted in the sense that the head is closed around an electric bundle.

Closing the first body (1) and the second body (2) such that the part is located inside the hollow space (5), and such that the conduits (3) of the two bodies (1, 2) are communicated with one another.

Threading a guide for the filament (6) into the conduit (3): although in principle it would be possible to thread the filament (6) into the conduit (3) of the head (10), it is simpler to first thread a guide with greater compressive strength than it is to thread the filament (6) and then pull on the guide attached to the filament (6).

Attaching one end of the filament (6) to the guide (9), for example by means of a hook, clamp, knot or the like. It is important for the section of the guide to be greater than the width of the groove (4) to prevent it from coming out of the conduit (3) during threading.

Threading the filament (6) along the entire conduit (3) of the knot-tying head (10) by means of pulling the guide. Once the guide and filament (6) are attached, simply pulling out the free end of the guide is enough for it to drag the filament (6) until it is completely introduced.

Separating the end of the filament (6) from the guide.

Tautening the filament (6) around the part by means of the same filament pulling device or by means of the tautening device.

Cutting the end of the filament (6) attached to the reel and removing the part tied up with a knot.

In a particular embodiment, the step corresponding to separating the end of the filament (6) from the guide can be carried out in a different order, for example after the step of tautening the filament (6), or after cutting the end of the filament (6).

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A knot-tying head adapted to form a knot with a filament around a part, which part having a cylindrical or prismatic portion, and wherein the knot-tying head comprises:

at least one first body, and at least one second body, complementary with the at least one first body, wherein the at least one first body and the at least one second body are configured such that a hollow space is formed between the first and second bodies when the bodies are attached together, and wherein the hollow space is configured to receive the part;

wherein the first body and the second body each comprise:

at least one conduit in the first body and the second body, the at least one conduit forming a path around, at least partially, the hollow space, and the at least one conduit being adapted to receive the filament;

at least one groove communicating the at least one conduit with the hollow space along all or part of a path of the at least one groove, wherein a width of the at least one groove is less than a width of the conduit and is greater than a width of the filament, and at least one opening to the at least one conduit, wherein the at least one opening is on an outside surface of the at least one first body or the at least one second body and the outside surface is separated from the hollow space by a side of the first or second bodies.

2. The knot-tying head according to claim 1, wherein the filament is a tape.

3. The knot-tying head according to claim 1, wherein the at least one first body and the at least one second body are attached in a hinged manner.

4. The knot-tying head according to claim 1, wherein the path of the conduit is configured for making a double capstan knot.

5. The knot-tying head according to claim 1, wherein the at least one opening is proximate to a hinge connecting the the at least one first body to the at least one second body.

6. The knot-tying head according to claim 1, wherein the at least one first body includes a first opening of the at least one conduit and the at least one second body includes a second opening to the at least one conduit, and the first and second openings are aligned to communicate with each other when the at least one first body and the at least one second body are attached together.

7. A knot-tying head comprising:

first body having a front face, a channel in the front face extending from one side of the first body to an opposite side of the first body, and a second face opposite to the front face and separated from the channel;

a second body having a front face and an channel in the front face extending from one side of the second body to an opposite side of the first body, wherein the front face of the second body is configured to seat against the front face of the first body such that the channels of the first and second bodies form an opening configured to receive a piece;

a conduit extending along a serpentine path through both of the first and second bodies and around the opening, wherein the conduit is continuous from an entrance opening in the second face to an exit opening in the second face;

a groove extending along the serpentine path through both of the first and second bodies, wherein the groove extends from the conduit to the opening along the lengths of the conduit, and a slot in the second face and extending between the groove at the entrance opening of the conduit and the groove at the exit opening of the conduit;

wherein a width of the conduit is greater than a width of the groove, and the width of the groove is greater than a width of a filament intended to move through the conduit.

8. The knot-tying head of claim 7 wherein the serpentine path is configured to cause the filament to form a knot around the piece after the filament slides from the conduit, through the groove and onto the piece.

9. The knot-tying head of claim 7 wherein the serpentine path encircles the opening at least twice.

10. The knot-tying head of claim 7 wherein the serpentine path forms a loop within at least one of the first or second bodies, and the serpentine path extends through the loop.

11. The knot tying head of claim 7 wherein a radial distance from a centerline of the opening to the serpentine path varies along the length of the path.

12. The knot tying head of claim 1, further comprising a slot in the outside surface, wherein the at least one opening includes an entrance opening and an exit opening both on the outside surface, and the slot extends between the groove communicating the conduit at the entrance opening to the groove communicating the conduit at the exit opening.

* * * * *